US006640736B1

(12) United States Patent
McLaughlin et al.

(10) Patent No.: US 6,640,736 B1
(45) **Date of Patent: *Nov. 4, 2003**

(54) SYNCHRONOUSLY DRIVEN, MULTIPLE CABLE BOAT LIFT

(75) Inventors: Shawn M. McLaughlin, Punta Gorda, FL (US); Daniel S. Carter, Fort Myers, FL (US); Charles L. Sargent, Bonita Springs, FL (US); John Kohlhauff, Estero, FL (US)

(73) Assignee: Quality Boat Lifts, Inc., Ft. Myers, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/179,115

(22) Filed: Jun. 25, 2002

Related U.S. Application Data

(63) Continuation of application No. 09/693,435, filed on Oct. 20, 2000, now Pat. No. 6,408,776, which is a continuation-in-part of application No. 09/585,116, filed on Jun. 1, 2000, now Pat. No. 6,230,639.

(51) Int. Cl.[7] ..... B63C 7/00
(52) U.S. Cl. ..... 114/44
(58) Field of Search ..... 405/3–7; 114/44, 114/45, 48

(56) References Cited

U.S. PATENT DOCUMENTS 5,772,360 A * 6/1998 Wood, II ..... 405/3
6,122,994 A * 9/2000 Norfolk et al. ..... 74/606 R
6,408,776 B1 * 6/2002 McLaughlin et al. ..... 114/44

* cited by examiner

*Primary Examiner*—Ed Swinehart
(74) *Attorney, Agent, or Firm*—William E. Noonan

(57) ABSTRACT

A synchronously driven, multiple cable boat lift is used in combination with proximal and distal support structures located on respective sides of a boat to selectively lift and lower the boat out of and into a body of water. The boat lift includes a motor mountable on the proximal support structure and being selectively driven in opposing first and second directions. A boat accommodating platform is located between the proximal and distal support structures and includes a pair of interconnected cradle beams for extending transversely beneath the boat from the first side to the second side of the boat. Each beam has a proximal portion and a distal portion positionable on the first and second sides of the boat respectively. A plurality of lift cables operably interconnect the motor and the platform for synchronously raising the proximal and distal portions of the beams when the motor is driven in the first direction and lowering the proximal and distal portions of the beam when the motor is driven in the second direction. This enables the boat supported on the platform to be raised and lowered, respectively.

37 Claims, 6 Drawing Sheets

SYNCHRONOUSLY DRIVEN, MULTIPLE CABLE BOAT LIFT

RELATED APPLICATION

This application is a continuation of U.S. patent application Ser. No. 09/693,435 filed Oct. 20, 2000, and now is issued as U.S. Pat. No. 6,408,776, which is in turn a continuation in part of U.S. patent application Ser. No. 09/585,116 filed Jun. 1, 2000 and now issued as U.S. Pat. No. 6,230,639.

FIELD OF THE INVENTION

This invention relates to a boat lift having a plurality of synchronized lifting cables. The lift eliminates the use of a cable beam longitudinally beside the boat.

BACKGROUND OF THE INVENTION

Boat lifts currently designed for use with medium and larger size vessels exhibit a number of shortcomings. Normally, such lifts feature a respective motor, winder and independently driven cable system mounted to support posts or pilings on each longitudinal side of the boat. As a result, these mechanisms tend to be quite expensive and complicated. Installation is usually time consuming and labor intensive. Utilizing multiple motors is particularly costly and inefficient. Moreover, it is often quite difficult to accurately synchronize the operation of the motors. The respective sides of the lift platform which supports the vessel are apt to be raised or lowered at different rates. The platform is thereby likely to tilt during operation.

At least one known four piling boat lift disclosed by Wood, U.S. Pat. No. 5,772,360, has eliminated independently operated cables and associated cable beams from respective longitudinal sides of the lift. Instead, that device employs a pair of motors and corresponding pulley assemblies mounted at the front and back ends of the boat lift. This apparatus continues to require a pair of motors, which are quite costly and inefficient. It also exhibits synchronization problems because of the use of multiple independent motors. Each motor in Wood operates a pair of winders having equal diameters. This requires the use of a complex differential gearing system in order to drive the winders and their respective cables at different speeds.

Most conventional multiple cable/multiple piling boat lifts experience significant problems associated with speed reduction. The output of each motor must be reduced to provide an appropriate winder speed and torque for raising and lowering the lift. Today, this almost always necessitates the use of a fairly complex reduction system.

Our pending U.S. application Ser. No. 09/585,116 discloses a boat lift which successfully addresses the shortcomings outlined above. We have further determined that, in certain applications, it would also be desirable to eliminate the longitudinal cable-accommodating beam used in this and other larger lifts. Such beams extend longitudinally between respective pairs of pilings or support posts located on one or both sides of the vessel being lifted. The so called "cable beam" requires the use of a significant amount of aluminum and adds significantly to the cost, weight and complexity of the lift apparatus. Extra time and expense are also required to install the longitudinal beam. A further disadvantage is that such beams usually cannot be used unless two spaced apart pilings or other types of support structures are mounted on one longitudinal side of the boat. The cable beam also has a tendency to obstruct the view in the vicinity of the boat lift.

This can be a particular disadvantage when the boat lift is situated in an area which would otherwise provide an attractive or scenic view.

We have also determined that increasing the diameter of the standard cable winder or drum would tend to prolong cable life significantly. When wound about a more gradually curved winder with a larger circumference, the cable is subject to less winding stress.

SUMMARY OF THE INVENTION

It is a therefore an object of this invention to provide a boat lift which greatly reduces the expense, weight and complexity normally associated with multiple cable/multiple piling boat lifts.

It is a further object of this invention to provide a boat lift that automatically, reliably and accurately synchronizes raising and lowering of the lifting cables or wires on both longitudinal sides of the boat lift so that an improved, stable and level lifting and lowering operation is achieved.

It is a further object of this invention to provide a boat lift that eliminates the need to use longitudinal cable beams and which therefore significantly reduces the weight, complexity and expense of the lift.

It is a further object of this invention to provide a longitudinally beamless boat lift that does not require cable beams so that the time, expense and difficulty of lift installation are reduced considerably.

It is a further object of this invention to provide an aesthetically improved boat lift that eliminates the need for longitudinal cable beams so that the view in the vicinity of the lift is not unduly obscured or marred.

It is a further object of this invention to provide a multiple cable boat lift that operates much more reliably and efficiently than known boat lifts.

It is a further object of this invention to provide a boat lift that exhibits simplified, reliable drive reduction and lengthened cable life.

It is a further object of this invention to provide a boat lift that does not require a differential gearing mechanism or other complex reduction means to synchronize lift operation.

It is a further object of this invention to provide a single motor, multiple cable boat lift that may be installed and repaired relatively quickly and conveniently.

It is a further object of this invention to provide a boat lift that may be used effectively with various combinations of single and multiple part lifting cables.

It is a further object of this invention to provide a boat lift that employs lifting cables on both sides of the lift platform so that heavier boats can be effectively raised, but which mounts the entire drive mechanism on only one side of the vessel so that an improved, simplified and much more efficient operation is achieved.

This invention features a synchronously driven, multiple boat lift including a proximal support structure located on a first side of a boat to be lifted. There is a distal support structure located on the opposite, second side of the boat. Drive motor means are mounted on the proximal support structure for selectively operating in opposing first and second directions. A boat accommodating platform is located between the proximal and distal support structures and includes a pair of interconnected cradle beams for extending transversely beneath the boat from the first side to the second side of the boat. Each cradle beam has a proximal portion and a distal portion positionable on the first and second sides of the boat respectively. There are means operably interconnecting the motor means and the platform for synchronously raising the proximal and distal portions of the beams when the motor means are driven in the first direction and lowering the proximal and distal portions of the beams when the motor means are driven in the second direction. This enables the boat supported on the platform to be raised and lowered respectively.

In a preferred embodiment, the means for raising and lowering include a pair of proximal cables, each of which is operably connected to the proximal portion of a respective beam for enabling raising and lowering thereof and a pair of distal cables, each of which is operably connected to the distal portion of a respective beam for enabling raising and lowering thereof. The means for raising and lowering may include cable transmission means operably interconnect the motor means and each of the proximal and distal cables for retracting the cables to synchronously raise the proximal and distal portions of the beams when the motor is driven in the first direction. The transmission means advance the cables to synchronously lower the proximal and distal portions of the beams when the motor is driven in the second direction.

The means for raising and lowering preferably include a winder assembly axially rotatably interconnected to and driven by the motor means. The winder assembly may include a pair of relatively large winder drums operably connected to respective distal cables. The means for raising and lowering may also include a second pair of relatively smaller diameter winder drums operably connected to respective proximal cables. The winder drums may be mounted to the proximal support structure for coaxial rotation. It is preferred that the drums be fixedly interconnected to one another and driven by a single, common motor for rotating in unison about a common axis of rotation. In alternative embodiments, two or more motors are used, and each motor may operate one large diameter and one small diameter drum. The respective drum diameters are selected such that the proximal and distal cables are driven at a relative rate of speed that achieves synchronized raising and lowering of the sides of the lift platform. These drums may be coaxially connected.

The proximal support structure typically consists of a first support member and the distal support structure includes spaced apart second and third support members. The first support member may be located longitudinally intermediate the second and third support members. The proximal portion of each cradle beam may be located adjacent the first support member and the distal portion of each cradle beam may be located adjacent a respective one of the second and third support members. The cradle beams may thereby diverge from the proximal to distal support structures (i.e. from the first to the second sides of the vessel). Alternatively, the support structures may include a pair of spaced apart support members located on each side of the vessel. Each cradle beam may extend generally between a respective support member on the first side of the boat and an associated support member on the opposite side of the boat. Such cradle beams are preferably arranged generally parallel to one another.

This invention also features a synchronously driven, longitudinally beamless boat lift for use in combination with conventional proximal and distal support structures located on respective sides of a boat. The structure of the lift is analogous to the structure summarized above.

BRIEF DESCRIPTION OF THE DRAWINGS

Other objects, features and advantages will occur from the following description of preferred embodiments and the accompanying drawings, in which.

Figure 1:
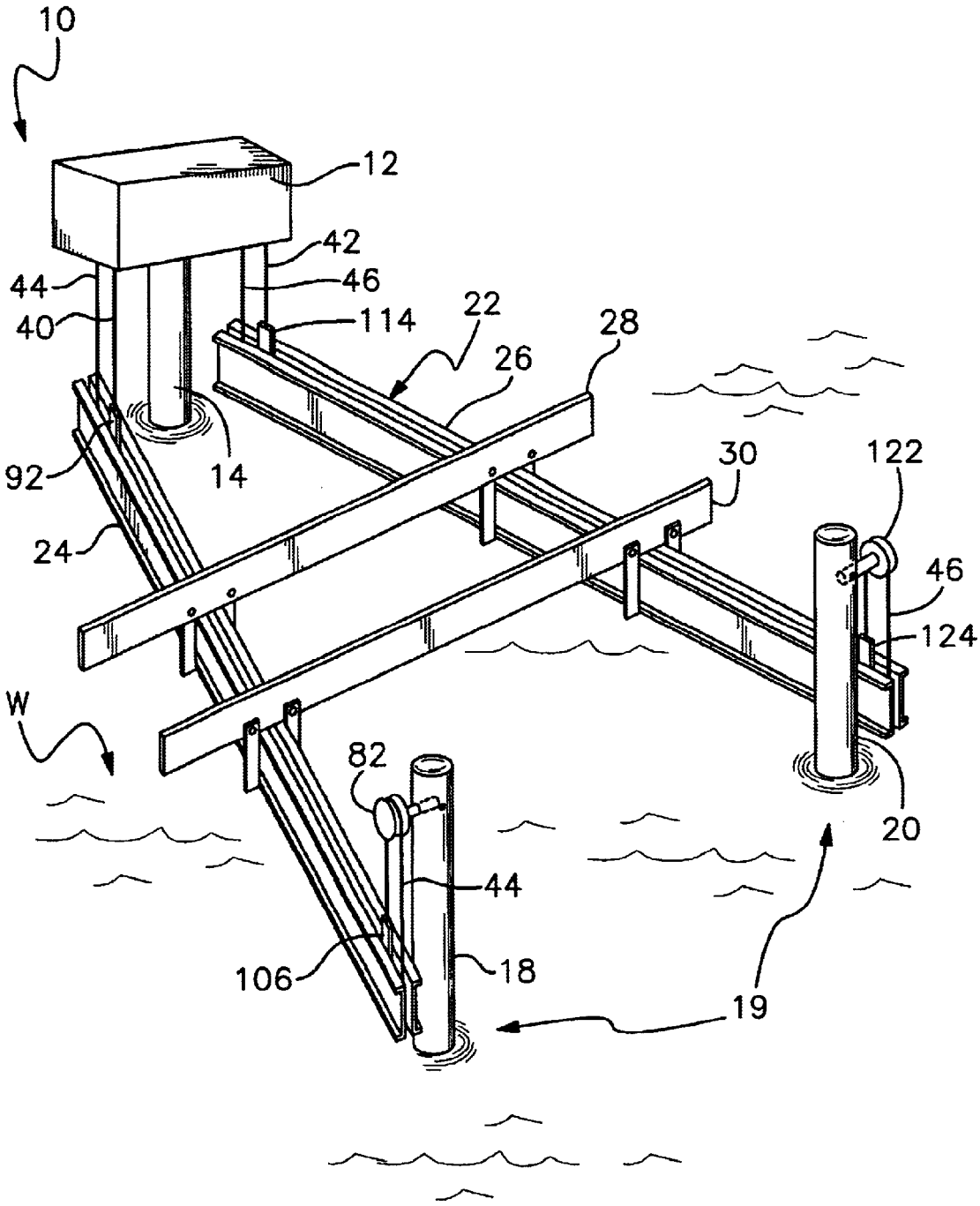
FIG. 1 is a perspective view of a preferred boat lift in accordance with this invention.
Figure 2:
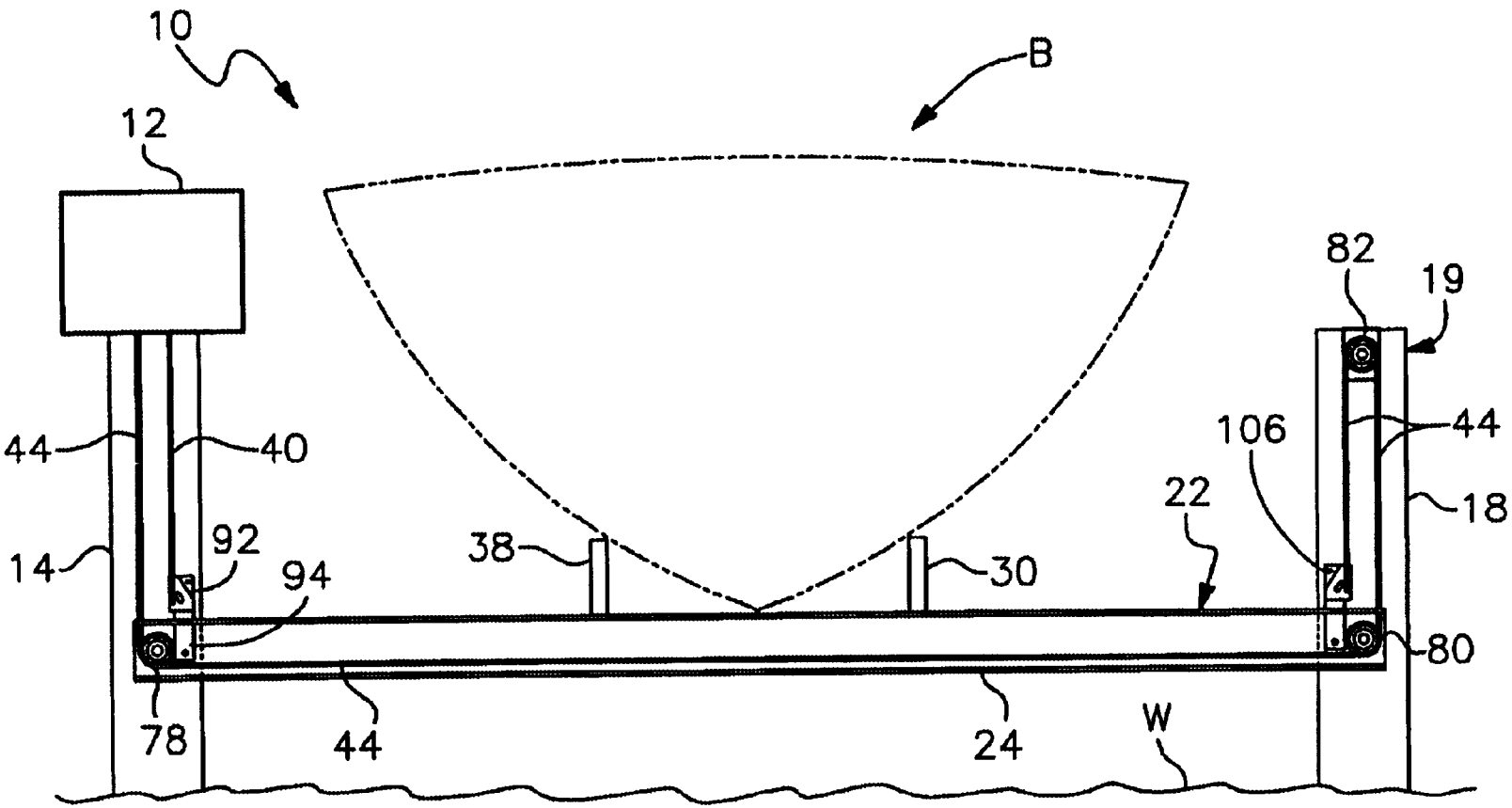
FIG. 2 is an elevational end view of the lift with the depicted cradle beam shown in cross section to illustrate the structure for operably engaging the lift cables with that beam.
Figure 3:
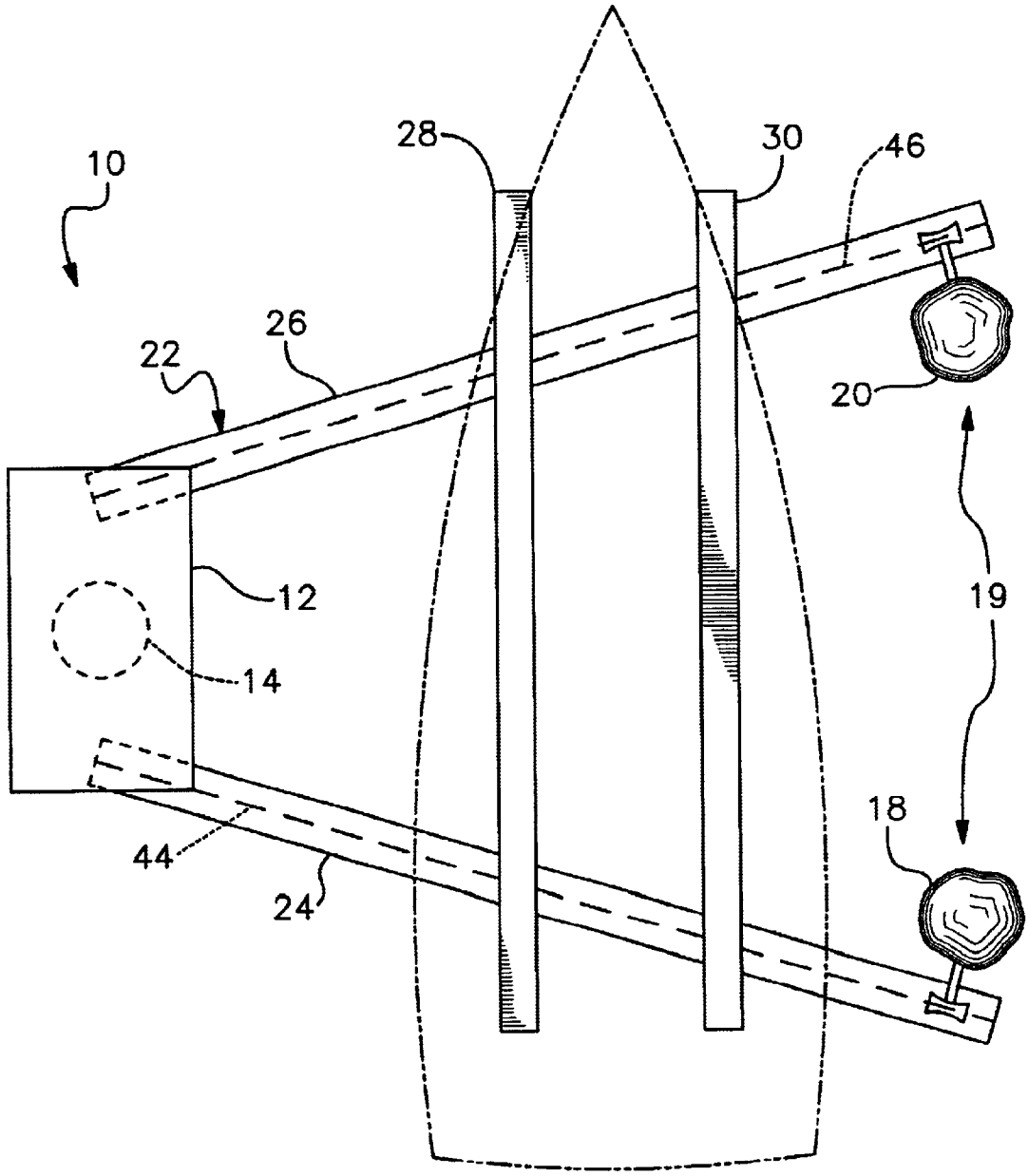
FIG. 3 is a top plan view of the lift.

There is shown in FIGS. 1 through 3 a preferred boat lift apparatus 10 comprising a single motor drive mechanism 12. Lift 10 is employed to selectively raise and lower a boat B, shown in phantom in FIGS. 2 and 3, out of and into a body of water W. It should be understood that the lift can be utilized for virtually all types of boats and other watercraft. The lift may be located proximate a dock, pier, seawall, or other structure bordering a boat slip or storage space. The apparatus is suitable for use in virtually any body of water in which a boat lift is normally employed.

Drive 12 is mounted on a proximal support structure consisting of a single piling or support post 14, FIGS. 1–3, which is typically arranged on or beside the dock, pier or sea wall. This piling is likewise positioned adjacent the body of water W in which the vessel is stored and, more particularly, is adjacent to one longitudinal side (i.e. the proximal side) of vessel B. Piling 14 (and each other support structure of this invention) may be composed of wood, concrete or a synthetic material. In alternative embodiments, the proximal support structure may comprise an assembly other than a single piling. For example, the support structure may include two or more posts or pilings arranged along the proximal side of the boat. The drive assembly may be mounted across or suspended from such support structure either directly or by means such as a longitudinal beam, bracket or truss. Preferably, however, a longitudinal beam is not utilized so that building material is conserved and the view around the boat lift is not blocked significantly.

As best shown in FIGS. 1–3, a second, distal support structure 19 is formed on the opposite longitudinal side of boat B. In this version, support structure 19 includes a longitudinally spaced apart pair of distal pilings 18 and 20 that are arranged generally triangularly with respect to proximal piling 14. More particularly, piling 14 is located longitudinally between pilings 18 and 20 such that the respective pilings generally define the vertices of a triangle. See FIGS. 1 and 3. Each of the pilings 14, 18 and 20 is mounted within (or alternatively proximate to) the body of water W in which the vessel is stored. Each piling extends upwardly from the water in a conventional manner. As best shown in FIGS. 2 and 3, when boat B is positioned on lift 10, piling 14 is arranged on a first longitudinal side of the boat and pilings 18 and 20 are positioned along the opposite second longitudinal side of the vessel. As previously stated, in alternative embodiments, the pilings may be replaced by other types and numbers of support structures within the scope of this invention.

Figure 4:
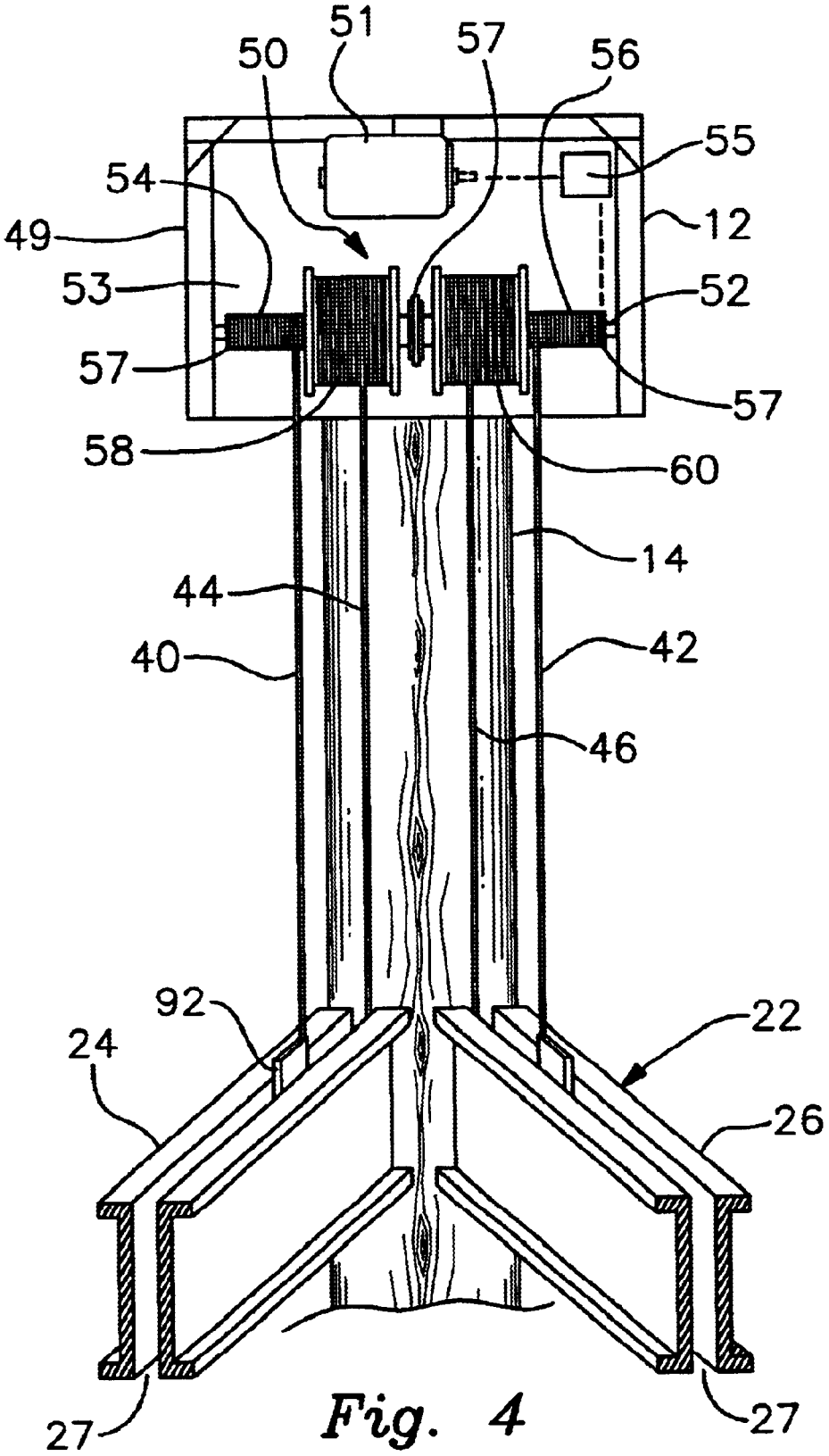
FIG. 4 is an elevational, partly cross sectional and partly cut away view of the proximal support structure and the drive motor assembly mounted thereon; the lifting cables are shown operably connected to the drive motor and the proximal ends of the diverging cable beams are shown operably interconnected to the lifting cables.
Figure 5:
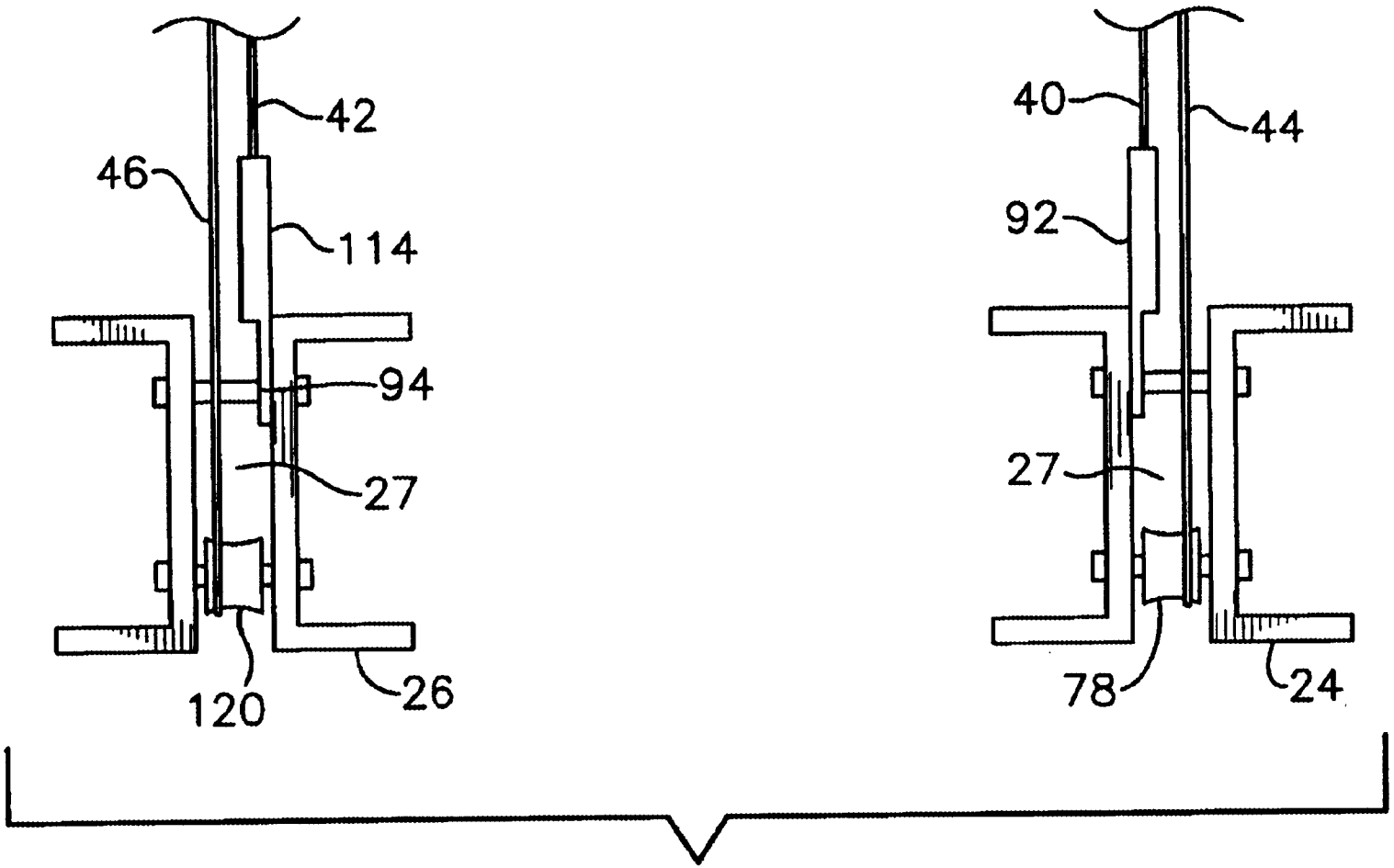
FIG. 5 is an elevational, proximal end view of the cradle beams specifically illustrating a preferred manner in which the lifting cables may be interconnected to the beams.

A lift platform 22 is operably (i.e. vertically movably) mounted to the support pilings. Platform 22 comprises a pair of generally diverging cradle beams 24 and 26 extending beneath boat B and arranged generally transversely to the axis of the boat. As best shown in FIGS. 4 and 5, each cradle beam may effectively comprise an I-beam formed by a pair of abutting, generally C-shaped channel members that are connected together by bolts, welding or other appropriate means. As is further described below, a gap 27 (exaggerated somewhat herein for clarity) is disposed between the adjoining channels of each beam for receiving directional pulleys that are mounted operably to the cradle beams. It should be understood that the cradle beams are composed of aluminum or similar rust resistant material. Beams 24 and 26 may comprise a wide variety of alternative constructions permitting the beams to carry directional pulleys that operably interengage with the lifting cables of the apparatus.

Lift platform 22, FIGS. 1–3, also includes a parallel pair of bunk boards 28 and 30 extending transversely across and mounted to the upper surfaces of cradle beams 24 and 26. The bunk boards extend generally longitudinally relative to the accommodated boat B. Bunk boards 28 and 30 typically comprise wood or appropriate synthetic materials. They are bolted or otherwise secured to the cradle beams in a known manner. When the boat B is mounted on the lift, it sits on the bunk boards as best shown in FIGS. 2 and 3.

Lift 10 includes four lifting cables that operably interconnect drive 12 with platform 22. Referring to FIGS. 1, 2, 4 and 5, a pair of single part cables 40 and 42 are connected at or near the proximal ends of cradle beams 24 and 26, respectively, directly beneath drive 12. As shown in FIGS. 1–3, a second pair of multiple part cables 44 and 46 are connected respectively to the outer or distal ends of cradle beams 24 and 26. These four cables are driven longitudinally by the single motor drive 12 of this invention to raise and lower lift platform 22. As used herein, "cables" may comprise multiple or single strand wire, rope or cord, as well as various other types of strong, durable, flexible and preferably corrosion resistant components (e.g. chain) suited for use in boat lifts. Each cable should be an elongate, flexible element. The particular composition is not a limitation of this invention.

As shown in FIG. 4, drive 12 includes an exterior enclosure or housing 49 that is attached to and supported on piling 14. A single motor 51, which may comprise assorted types and sizes of motors suitable for use in the boat lift industry, is supported within housing 49 by brackets, bolts or other standard means. The motor should be operable in opposing first and section directions for respectively raising and lowering the boat accommodating platform 22.

The first or upper end of each cable is operably connected to cable transmission means 50, which may comprise a winder assembly, shown in FIG. 4. The winder assembly is supported along with motor 51 within enclosure 49. Housing 49 may be secured to piling 14 by various known means of attachment including bolts, straps and/or brackets.

The motor is operably connected by cable transmission means 50 to each of the lift cables 40, 42, 44 and 46. Cable transmission means 50 specifically include a coaxial four drum winder assembly 53. The winder assembly is operably connected to motor 51 by appropriate known forms of reduction means 55 such as sprockets and chains, belts and pulleys, gears or otherwise. Assembly 53 features an axially rotatable shaft 52 that is mounted within appropriate bearings 57 in housing 49. Four winder segments or drums 54, 56, 58 and 60 are axially fixedly joined along shaft 52 such that the drums axially rotate in unison with the shaft. In alternative embodiments, the drums may rotate about a fixed shaft or the shaft may be eliminated and the interconnected drums may be rotatably and axially supported by appropriate bearings. The drums may also be disengaged from one another and independently rotated by respective reduction means. Such means may again comprise chains and sprockets, belts and pulleys and/or gears which appropriately reduce the speed of the motor to the speed required for each winder drum. Small diameter drums 54 and 56 are single part winder segments. Single part cables 40 and 42 are connected to and wound upon drums 54 and 56, respectively, in a known manner. Likewise, multiple part cables 44 and 46 are respectively connected to and wound upon large diameter drums 58 and 60.

In operation, motor 51 rotates in a first direction to drive the winder drums, 54, 56, 58 and 60 in a direction that winds the respective cables 40, 42, 44 and 46 onto the respective drums. Alternatively, motor 51 may be driven in the opposite direction so that the winder segments rotate to deploy the cables from the respective drums. This operation is described more fully below.

As shown in FIGS. 1–5, each of the cables drops downwardly from housing 49 of drive 12, and is secured proximate a respective end of one of the cable beams of platform 22. Each of the single part cables 40 and 42 is suspended vertically from a respective drum segment 54 and 56 and is secured directly to a proximate end portion of a respective cradle beam 24 and 26. Each of the multiple (three) part cables 44 and 46 hangs from a respective large diameter drum 58, 60 and directed by three directional pulleys, described below, to the distal end of a respective cradle beam 24, 26. Cables 44 and 46 are then secured proximate the respective distal ends of the beams.

More particularly, as best depicted by FIGS. 1, 2, 4 and 5, single part cable 40 hangs from winder segment 54 and passes through an opening in the bottom of housing 49. The lower end of cable 40 is releasably secured to a cable lock apparatus 92 of the type disclosed in U.S. Pat. No. 5,988,941. The cable lock includes a depending mounting bracket 94, FIGS. 2 and 5, that is interconnected between the abutting C-channels of cradle beam 24. When cable 40 is raised and lowered, this correspondingly raises and lowers the proximal end portion of cradle beam 24. That operation is described more fully below.

The opposite, distal end of cradle beam 24 is secured to multiple part (i.e. three part) cable 44. As shown in FIG. 4, cable 44 is suspended from large diameter winder drum 58 and is directed downwardly to a proximal end portion of cradle beam 24, where the cable operably engages a first directional pulley 78 that is mounted in the gap 27 between the C-channels of cradle beam 24. Once again, this gap is exaggerated for clarity. Pulley 78 may be mounted to the cradle beam in a number of ways other than that shown. Pulley 78 directs multiple part cable 44 longitudinally through the cradle beam as depicted in FIG. 2. The multiple part cable 44 proceeds to the distal or outer end portion of cradle beam 24 (e.g. the end adjacent piling 18). There, cable 44 operably engages a second directional pulley 80 mounted between the abutting C-channels. As shown in FIGS. 1 and 2, this directs cable 44 vertically upwardly and generally along outer piling 18. The cable next engages a third directional pulley 82 mounted by any appropriate means proximate the upper end of piling 18. This again causes cable 44 to reverse direction. The cable drops vertically downwardly along the piling and is secured by a releasable cable lock 106 attached to beam 24 in a manner analogous to that previously described for lock 92. Cable 44 and its associated directional pulleys 78, 80 and 82 thus form an operational three part cable assembly. When cable 44 is retracted (in the manner that will described below) this causes the distal end of cradle beam 24 to be raised. Alternatively, when cable 44 is extended or deployed from its winder drum 58, the distal end of cradle beam 24 is lowered.

The second single part cable 42 and second multiple part cable 46 are operably connected to second cradle beam 26 in an analogous manner. Cable 42 drops downwardly from small diameter winder segment 56 and exits through an opening in the bottom of housing 49 (see FIG. 4). The lower end of cable 42 is fastened to the proximal end portion of cradle beam 26 by a cable lock 114, FIGS. 1 and 5. This form of attachment is similar to previously described for cable lock 92.

Second multiple part cable 46 drops from winder segment 60 and likewise exits housing 49. This multiple part cable engages directional pulley 120, FIG. 5, mounted in the gap 27 between the C-channels of cradle beam 26. As previously described, cable 46 is directed longitudinally through beam 26 to the distal, outer end of that cradle beam, FIG. 3. An associated second directional pulley mounted to the distal end portion of beam 26 (not shown, but see analogous pulley 80 mounted to beam 24 in FIG. 2) directs cable 46 upwardly along piling 20. A third directional pulley 122, FIG. 1, redirects cable 46 downwardly along piling 20, in a manner analogous to that previously described for cable 44. The distal end of cable 46 is then releasably secured by a cable lock 124, FIG. 1, to a distal portion of cradle beam 26. The cable lock is again analogous to the cable locks previously described herein.

Cables 42 and 46 are extended and retracted in a manner similar to the manner previously described for cables 40 and 44. As a result, the proximal and distal ends of cradle beam 26 are raised and lowered synchronously as required.

In operation, motor 51 is driven selectively in a first direction to raise the lift and in an opposite, second direction to lower the lift. After a boat B is positioned on the lift platform 22 in a manner shown in the accompanying drawings, it may be raised by operating the motor in the first direction. Motor 51 operates the reduction mechanism 55 to rotate winder drum segments 54, 56, 58 and 60 at a desired speed so that the respective cables are wound thereon. In particular, cables 40, 42, 44 and 46 are wound onto winder drums 54, 56, 58 and 60, respectively. This pulls and retracts the individual cables. Single part cables 40 and 42 are wound onto winder segments 54 and 46, respectively, so that the proximal ends of beams 24 and 26 are raised at the same rate of speed. A consistent rate of speed is ensured by making the drum segments 54 and 56 equal in diameter. Likewise, multiple part cables 44 and 46 are retracted onto their respective drum segments 58 and 60, which also feature identical diameters. Cables 44 and 46 are thereby retracted over their respective sets of directional pulleys at a consistent rate of speed. Specifically, cable 44 is drawn over pulleys 78, 80 and 82. Cable 46 is likewise retracted over pulleys 120 and 122, and the obscured pulley mounted to the distal end of cradle beam 26. By providing the respective winder drum segments with properly proportioned diameters, the single and multiple part cables are drawn upwardly at identical speeds. The lift platform is thereby raised synchronously, stably, uniformly and evenly. Dangerous tilting is avoided. The lift platform and supported vessel are subsequently lowered, when required, by simply reversing operation of the motor to synchronously extend or drop the lift cables. Stable, even and consistent movement of the platform is again exhibited.

By employing fixedly interconnected winder drums having correctly proportioned diameters, the present invention eliminates the need to employ unduly complex and expensive reduction means for providing synchronous operation of the proximal and distal cable assemblies. Typically, the multiple part winder drums 58 and 60 have a diameter that is three times the diameter of the single part drums 54 and 56. This provides the multiple part cables 44 and 46 with a speed that is three times the speed imparted to the single part cables. In alternative embodiments the respective winder drums may be mounted for independent rotation relative to one another. In such cases, each drum is operably connected through a respective reduction mechanism to motor 51.

The lift apparatus of this invention uses far fewer components than are required by conventional lifts of this type. As a result, the lift is fairly simple to assemble and maintain. The cables are driven in a synchronized manner and operate quite reliably so that improved boat lift operation is achieved. The apparatus is extremely cost efficient. It requires the use of only a single motor, which reduces boat lift costs considerably and eliminates the need to synchronize multiple motors. Additionally, the drive assembly is compact, relatively uncomplicated and easy to access. Indeed, the motor and all of the power transmitting structure is located in a housing conveniently mounted on a piling or other relatively compact support structure. In most cases, the longitudinal cable beam heretofore used to accommodate longitudinal movement of the lifting cables, may be omitted. This saves considerable weight, material and expense and significantly reduces the labor, time and costs associated with installing the lift. Eliminating the cable beam also provides a clearer, less obstructed view in the area of the boat lift.

Various other embodiments may be employed within the scope of this invention. In each version, the lift platform and cable interconnections to the platform may be constructed in the manner to that previously described or in some other similar fashion that should be known to those skilled in the art. It should also be understood that the invention is not limited to a single part and three part cable as shown herein. Various other combinations of single and multiple part cables may be employed within the scope of this invention.

Figure 6:
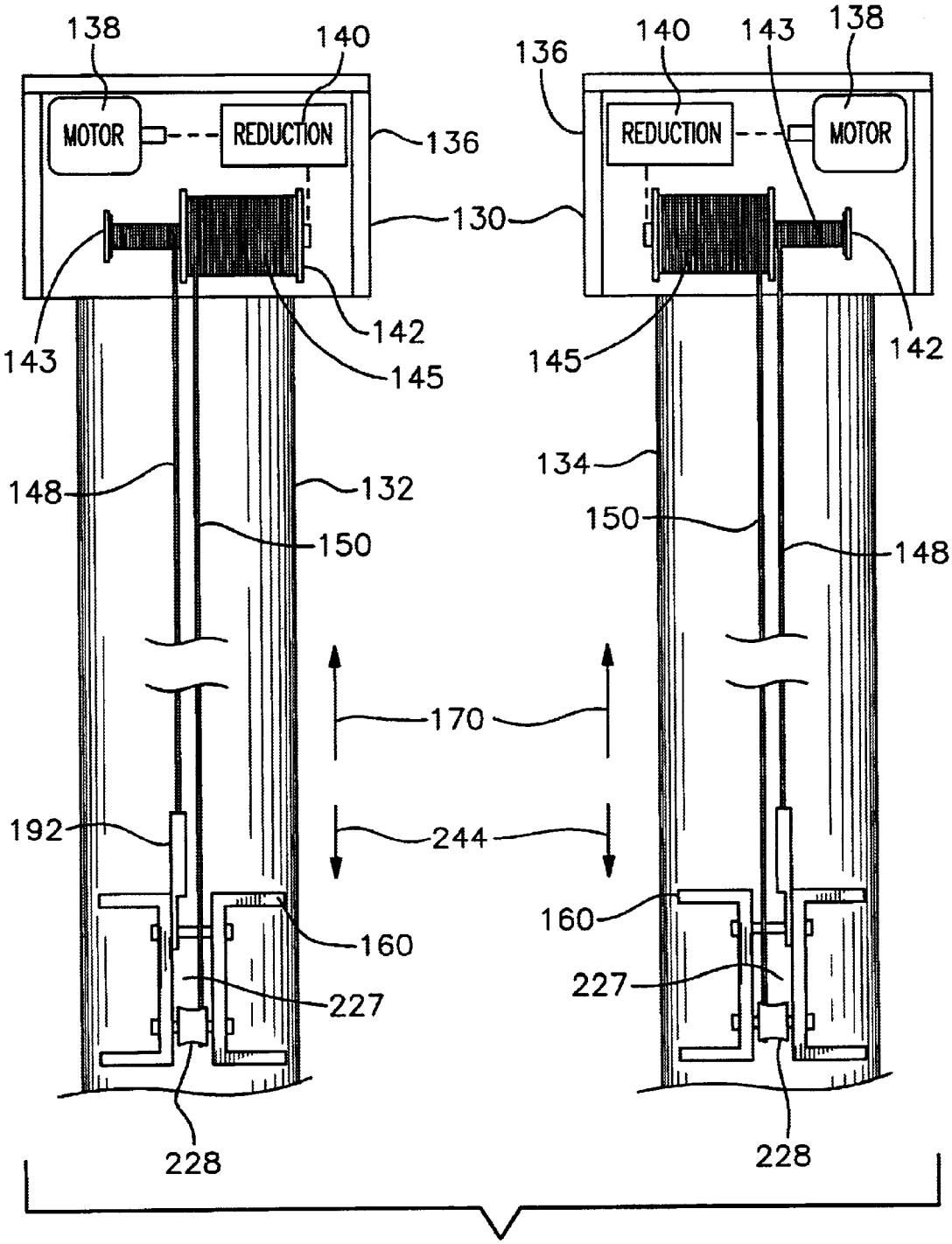
FIG. 6 is an elevational, cross sectional and party schematic view of an alternative embodiment that employs a pair of drive motors, each having an associated pair of differentially sized winder drums for driving the proximal and distal cables respectively; the cradle beams extend in a parallel manner beneath the vessel.

It should be understood that other versions of this invention may employ a plurality of distinct motors and drive assemblies. For example, as shown in FIG. 6, the lift may include a pair of drive assemblies 130. Each drive assembly is mounted on a respective piling or other type of support structure 132, 134. These support structures are located on the first, proximal side of the vessel to be lifted. More particularly, each drive assembly 130 includes a housing 136 that encloses a standard two-directional motor 138 that is analogous to the motor previously described. Motor 138 is mounted by appropriate brackets or other means within enclosure 136. The output shaft of the motor is connected as depicted schematically through a standard (gear, pulley or chain and sprocket) reduction device 140 to a respective winder assembly 142. The winder assembly is supported for axial rotation within enclosure 136 by appropriate bearings. Each winder assembly 142 includes a first drum 143 and a second, larger diameter drum 145. Typically, drum 145 has a diameter that is approximately three times the diameter of drum 143. The respective drums within each assembly 142 are axially fixed to one another such that they are rotated in unison by associated motor 138. When the drum rotates in a first direction, drums 143 and 145 likewise rotate in a first direction. Conversely when the motor reverses direction, the drums axially rotate in a reverse direction.

A respective lifting cable is wound upon and hangs from each of the winder drums. In particular, a single part proximal cable 148 is operably connected to each of the small diameter drums 143. Likewise, a three part distal cable 150 is operably connected to each of the large diameter drums 145. The cables hang through appropriate openings formed in the bottom of the housing 136 of each drive assembly. Each associated pair of cables 148, 150 driven by a particular motor 138 are operably attached to a respective cradle beam 160. In particular, proximal cable 148 is secured by a clamp 192 to a proximal end portion of beam 160. The other cable 150 extends through the gap 227 of the cradle beam and is operably engaged with a plurality of directional pulleys 228 (only one of each is shown for each cradle beam in FIG. 6) in the manner described for first embodiment. As in the prior embodiment, the pulleys 228 are mounted within gap 227 between adjoining segments of the beam. Each of cables 148, 150 is thereby operably connected to the distal end portion of a respective cradle beam, more or less in accordance with the manner previously described in FIGS. 1–5.

In the version shown in FIG. 6, a spaced apart, parallel pair of cradle beams 160 are utilized. Each cradle beam is suspended from drive assembly 130 by a respective pair of cables 148, 150. Each cradle beam extends generally between a first pier or other support structure on the first (proximal) side of the vessel and a second pier or analogous support structure (not shown) located on the opposite second (distal) side of the vessel to be lifted.

In operation, motors 138 are started simultaneously and operated in a first direction to turn respective winders 142 such that cables 148 and 150 are raised longitudinally in the direction of arrows 170. This causes cables 148 and 150 to be wound onto winder drums 143 and 145 respectively. The winder drum 145 has diameter three time that of interconnected drum 143. As a result, the distal cables 150 are operated three times faster than the proximal cables 148, or at least sufficiently faster such that the opposing sides of the platform are raised in a uniform, synchronous and level manner. Such synchronous lifting is quite helpful in avoiding dangerous and potentially costly boat lift accidents.

Conversely, motor 138 may be operated in an opposite direction such that cables 148 and 150 are longitudinally deployed or advanced from their respective winder drums. This causes the parallel cradle beams 160 to be lowered in the direction of arrows 244. Once again, the relative diameters of drums 143 and 145 cause the proximal and distal end portions of each beam to be lowered in a controlled, synchronous manner (i.e. at the same speed).

The second version of this invention achieves the same synchronous, controlled and uniform lifting and lowering operation that is accomplished using the first embodiment. The second version differs somewhat because multiple, split motors and parallel cradle beams are employed. In still other versions, a single motor may be employed with a pair of parallel cradle beams. In such cases, the motor may drive a winder assembly having an extended axle or a drive shaft. A first pair of relatively small diameter winder drums may be employed for operably raising and lowering respective proximal cables. A second pair of larger diameter drums are operably connected to respective distal cables. Once again, the drums may be axially fixedly interconnected to one another such that they rotate in unison. Alternatively, each of the four drums may be separately interconnected to the rotatable drive shaft and driven thereby when the motor operates the shaft in the desired direction.

Each version of this invention achieves a smooth, even and synchronized lifting and lowering operation. This is achieved largely through the unique use of coaxial winder drums with different diameters for respectively driving the proximal and distal cables of each opposing pair at relative speed proportional to the respective drum diameters. As has been described, each such pair of cables is typically associated with and attached to the proximal and distal ends of a particular cradle beam. Either a single motor or a split pair of motors performs the lifting and lowering of all lift cables. A simpler, less expensive, more efficient and nonetheless very effective boat is lift is thereby provided.

Although the embodiment disclosed herein employs four cables, it should be understood that the device may be used in conjunction with various other numbers of cables and other combinations of single and multiple part cable lifting systems. In some versions, only a single cable may be mounted on the first, proximal side of the boat. For example, that cable may carry a yoke, mounting bracket or other form of connection which attaches the single cable to the proximal end portion of each of the diverging cradle beams. In other words, the proximal ends of the respective cradle beams may be lifted by either a single cable or a pair of cables as previously shown. In either event, the proximal and distal cables and their respective cable transmission means are synchronized in speed and diameter such that the proximal and distal sides of the lift platform are raised and lowered in a level, synchronous fashion. It is critical that in each embodiment, a synchronized operation is achieved. The unique use of winder drums with different diameters synchronizes the rate at which the sides of the lift platform are raised and lowered and accomplishes that without requiring the use of differential gearing or other complex reduction means. Additionally, cable beams are omitted so that the previously described advantages are achieved.

From the foregoing it may be seen that the apparatus of this invention provides for a boat lift having differentially sized winder drums that operate a plurality of synchronized lifting cables. While this detailed description as set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some drawings and not others, this is for convenience only, as each feature may be combined with any or all of the other features in accordance with the invention.

Other embodiments will occur to those skilled in the art and are within the following claims.

What is claimed:

1. A synchronously driven, multiple cable boat lift for use in combination with opposing support structures located on respective sides of a boat to selectively lift and lower the boat out of and into a body of water between the support structures, said boat lift comprising:

a motor assembly mountable on at least one of the support structures, for operating selectively in opposing first and second directions;

a boat accommodating platform locatable between the opposing support structures and extendable beneath the boat, said platform having a proximal portion and a distal portion positionable respectively on respective longitudinal sides of the boat;

a plurality of lifting cables for suspending said platform from the support structures, which cables supportively engage one of said proximal and distal portions of said platform at multiple, longitudinally separated attachment points relative to the side of the boat and the other of the proximal and distal portions of the platform at an attachment point that is longitudinally intermediate the separated attachment points, said cables for enabling raising and lowering of said platform;

a rotatable winder assembly upon which said cables are wound; and a reduction mechanism operably interconnecting said motor assembly and said winder assembly such that operation of said motor assembly in a first direction drives said winder assembly and said cables to synchronously raise said proximal and distal portions of said platform and operation of said motor in an opposite second direction drives said winder assembly and said cables to synchronously lower said proximal and distal portions of said platform, whereby said platform is raised and lowered.

2. The boat lift of claim 1 in which said plurality of lift cables comprise a pair of proximal cables, each of which is operably connected to a proximal portion of said platform and a pair of distal cables, each of which is operably connected to a distal portion of said platform for enabling raising and lowering thereof.

3. The boat lift of claim 2 in which said distal cables are arranged to extend transversely across said platform substantially non parallel to each other.

4. The boat lift of claim 1 in which each said proximal cable comprises a single part cable.

5. The boat lift of claim 1 in which each said distal cable comprises a three part cable.

6. The boat lift of claim 1 in which said distal cables extend divergently to one another between said proximal and distal portions of said platform.

7. The boat lift of claim 1 in which said cables are attached to said platform in a substantially trapezoidal configuration.

8. The boat lift of claim 1 in which said motor assembly includes a single motor, said winder assembly includes a single winder and said reduction mechanism includes a reduction device operably interconnecting said motor and said winder.

9. The boat lift of claim 1 in which said motor assembly includes a pair of motors, said winder assembly includes a pair of winders respectively associated with said motors and said reduction mechanism includes a pair of reduction devices, each operably interconnecting a respective motor and winder.

10. A synchronously driven, multiple cable boat lift for use in combination with proximal and distal support structures located on respective first and second sides of a boat to selectively lift and lower the boat out of and into a body of water between the support structures, said boat lift comprising:

a single motor mountable on the proximal support structure, for operating selectively in opposing first and second directions;

a boat accommodating platform locatable between the proximal and distal support structures and extendable beneath the boat, said platform having a proximal portion and a distal portion positionable respectively on the first and second sides of the boat; and means operably interconnecting said motor and said platform for synchronously raising said proximal and distal portions of said platform when said motor is driven in said first direction and lowering said proximal and distal portions of said platform when said motor is driven in said second direction, whereby the boat supported on said platform is raised and lowered respectively;

said means for raising and lowering including at least one proximal cable operably connected to said proximal portion of said platform and a pair of distal cables, each of which is operably connected to said distal portion of said platform for enabling raising and lowering thereof, said distal cables being arranged to extend transversely across said platform non parallel to each other.

11. The boat lift of claim 10 in which said proximal cable comprises a single part cable.

12. The boat lift of claim 10 in which each said distal cable comprises a three part cable.

13. The boat lift of claim 10 in which said platform is suspended by said cables and further including a pair of proximal cables, said cables being attached to said platform in a substantially trapezoidal configuration.

14. The boat lift of claim 10 in which said distal cables extend divergently to one another between said proximal and distal portions of said platform.

15. The boat lift of claim 10 in which said means for raising and lowering include a winder assembly on which said cables are wound and a reduction mechanism operably connecting said motor and said winder assembly, said winder assembly and said reduction mechanism retracting said cables to synchronously raise said proximal and distal portions of said platform when said at least one motor is operated in a first direction and advancing said cables to synchronously lower said proximal and distal portions of said platform when said at least one motor is operated in an opposite second direction.

16. A single motor, synchronously driven boat lift comprising:

a proximal support structure locatable on a first side of the boat to be lifted;

a distal support structure locatable on an opposite second side of the boat;

a single motor mounted on said proximal support structure and being selectively driven in opposing first and second directions;

a boat accommodating platform located between said proximal and distal support structures and including an elongate pair of interconnected cradle beams for extending across and beneath the boat from the first side to the second side of the boat, each said beam having a proximal portion and a distal portion positionable respectively on the first and second sides of the boat;

a pair of proximal cables, each of which is operably connected to said proximal portion of a respective beam for enabling raising and lowering thereof and a pair of distal cables, each of which is operably connected to said distal portion of a respective said beam for enabling raising and lowering thereof;

a rotatable winder assembly having a pair of relatively large diameter winder drums operably connected to respective distal cables and a second pair of relatively small diameter winder drums operably connected to respective proximal cables; and a reduction mechanism operably interconnecting said motor and said winder assembly such that operation of said motor in a first direction drives said winder assembly to synchronously raise said proximal and distal portions of said beams and operating said motor in a second direction drives said winder assembly to synchronously lower said proximal and distal portions of said beams, whereby said platform is raised and lowered, respectively.

17. The boat lift of claim 16 in which said proximal support structure comprises a first support member and said distal support structure includes longitudinally spaced apart second and third support members, said first support member being located longitudinally intermediate said second and third support members.

18. The boat lift of claim 17 in which said proximal portion of each said beam is adjacent said first support member and said distal portion of each said beam is adjacent a respective one of said second and third support members, respectively.

19. The boat lift of claim 16 in which said winder drums are mounted to said proximal support structure for coaxial rotation.

20. The boat lift of claim 16 in which said drums are fixedly interconnected for rotating in unison about a common axis of rotation.

21. A single motor, synchronously driven boat lift for use in combination with proximal and distal support structures located respectively on first and second sides of a boat to selectively lift and lower the boat out of and into a body of water between the support structures, said boat lift comprising:

a single motor mountable on the proximal support structure and being selectively driven in opposing first and second directions;

a boat accommodating platform locatable between the proximal and distal support structures and including an elongate pair of interconnected cradle beams for extending across and beneath the boat from the first side to the second side of the boat, each said beam having a proximal portion and a distal portion positionable respectively on the first and second sides of the boat;

a pair of proximal cables, each of which is operably connected to said proximal portion of a respective beam for enabling raising and lowering thereof and a pair of distal cables, each of which is operably connected to said distal portion of a respective said beam for enabling raising and lowering thereof;

a rotatable winder assembly having a pair of relatively large diameter winder drums operably connected to respective distal cables and a second pair of relatively small diameter winder drums operably connected to respective proximal cables; and a reduction mechanism operably interconnecting said motor and said winder assembly such that operation of said motor in a first direction drives said winder assembly to synchronously raise said proximal and distal portions of said beams and operating said motor in a second direction drives said winder assembly to synchronously lower said proximal and distal portions of said beams, whereby said platform is raised and lowered, respectively.

22. The boat lift of claim 21 in which said winder drums are mounted to said proximal support structure for coaxial rotation.

23. The boat lift of claim 21 in which said drums are fixedly interconnected for rotating in unison about a common axis of rotation.

24. A synchronously driven boat lift comprising:

a proximal support structure locatable on a first side of the boat to be lifted;

a distal support structure locatable on an opposite second side of the boat;

a motor mounted on said proximal support structure and being selectively driven in opposing first and second directions;

a boat accommodating platform located between said proximal and distal support structures and including an elongate pair of interconnected cradle beams for extending divergently relative to one another across and beneath the boat from the first side to the second side of the boat, each said beam having a proximal portion and a distal portion positionable respectively on the first and second sides of the boat;

a pair of proximal cables, each of which is operably connected to said proximal portion of a respective said beam for enabling raising and lowering thereof and a pair of distal cables, each of which is operably connected to said distal portion of a respective said beam for enabling raising and lowering thereof;

a winder assembly upon which said proximal and distal cables are wound; and a reduction mechanism operably interconnecting said motor and said winder assembly such that operation of said motor in a first direction synchronously raises said proximal and distal portions of said beams and operation of said motor in an opposite second direction synchronously lowers said proximal and distal portions of said beams, whereby said platform is raised and lowered, respectively.

25. A synchronously driven boat lift comprising:

a proximal support structure including a single support piling locatable on a first side of the boat to be lifted;

a distal support structure including a pair of distinct, spaced apart support pilings locatable on an opposite second side of the boat, said single support piling of said proximal support structure positioned longitudinally intermediate said spaced apart pilings of said distal support structure such that said support pilings define respective vertices in a triangular configuration;

a motor mounted on said proximal support structure and being selectively driven in opposing first and second directions;

a boat accommodating platform located between said proximal and distal support structures and including an elongate pair of interconnected cradle beams for extending across and beneath the boat from the first side to the second side of the boat, each said beam having a proximal portion and a distal portion positionable respectively on the first and second sides of the boat;

a pair of proximal cables, each of which is operably connected to said proximal portion of a respective said beam for enabling raising and lowering thereof and a pair of distal cables, each of which is operably connected to said distal portion of a respective said beam for enabling raising and lowering thereof;

a winder assembly upon which said proximal and distal cables are wound; and a reduction mechanism operably interconnecting said motor and said winder assembly such that operation of said motor in a first direction synchronously raises said proximal and distal portions of said beams and operation of said motor in an opposite second direction synchronously lowers said proximal and distal portions of said beams, whereby said platform is raised and lowered, respectively.

26. The boat lift of claim 21 in which said cradle beams extend divergently relative to one another.

27. The boat lift of claim 24 in which said proximal support structure includes a single support piling locatable on the first side of the boat and said distal support structure includes a pair of distinct, spaced apart support pilings locatable on the second side of the boat to be lifted, said single support piling of said proximal support structure being positioned longitudinally intermediate said spaced apart pilings of said distal support structure.

28. The boat lift of claim 25 in which said cradle beams extend divergently relative to one another.

29. A synchronously driven boat lift comprising:

a proximal support structure locatable on a first side of the boat to be lifted;

a distal support structure locatable on an opposite second side of the boat;

one of said proximal and distal support structures including a single support component and the other of said proximal and distal support structures including a distinct, spaced apart pair of support components, said single support component positioned longitudinally intermediate said spaced apart support components such that said support components define respective vertices in a triangular configuration;

a motor assembly mounted on at least one of said support structures and being selectively driven in opposing first and second directions;

a boat accommodating platform located between said proximal and distal support structures and extending across and beneath the boat from the first side to the second side of the boat, said platform having a proximal portion and a distal portion positionable respectively on the first and second sides of the boat;

a plurality of lifting cables for suspending said platform from said support structures and enabling raising and lowering of said platform relative to said support structures;

a winder assembly upon which said cables are wound; and a reduction mechanism operably interconnecting said motor assembly and said winder assembly such that operation of said motor assembly in a first direction synchronously raises said proximal and distal portions of said platform and operation of said motor assembly in an opposite second direction synchronously lowers said proximal and distal portions of said platform, whereby said platform is raised and lowered, respectively.

30. The boat lift of claim 29 in which said plurality of lift cables comprise a pair of proximal cables, each of which is operably connected to a proximal portion of said platform and a pair of distal cables, each of which is operably connected to a distal portion of said platform for enabling raising and lowering thereof.

31. The boat lift of claim 30 in which said distal cables are arranged to extend transversely across said platform substantially non parallel to each other.

32. The boat lift of claim 29 in which each said proximal cable comprises a single part cable.

33. The boat lift of claim 29 in which each said distal cable comprises a three part cable.

34. The boat lift of claim 29 in which said distal cables extend divergently to one another between said proximal and distal portions of said platform.

35. The boat lift of claim 29 in which said cables are attached to said platform in a substantially trapezoidal configuration.

36. The boat lift of claim 29 in which said motor assembly includes a single motor, said winder assembly includes a single winder and said reduction mechanism includes a reduction device operably interconnecting said motor and said winder.

37. The boat lift of claim 29 in which said motor assembly includes a pair of motors, said winder assembly includes a pair of winders respectively associated with said motors and said reduction mechanism includes a pair of reduction devices, each operably interconnecting a respective motor and winder.

* * * * *